United States Patent [19]

Gile et al.

[11] Patent Number: 4,624,236

[45] Date of Patent: Nov. 25, 1986

[54] ORTHOGONAL DRESSING OF GRINDING WHEELS

[75] Inventors: Richard H. Gile, North Clarendon, Vt.; Edward C. Bourgoine, Claremont, N.H.

[73] Assignee: Ex-Cell-O Corporation, Troy, Mich.

[21] Appl. No.: 802,148

[22] Filed: Nov. 27, 1985

Related U.S. Application Data

[62] Division of Ser. No. 645,373, Aug. 29, 1984.

[51] Int. Cl.[4] ..... B24D 53/00

[52] U.S. Cl. ..... 125/11 R

[58] Field of Search ..... 125/11 R, 11 PH, 11 CC, 125/11 CD, 11 TP; 51/165.71, 325

[56] References Cited

U.S. PATENT DOCUMENTS

| | | | |
|---|---|---|---|
| 2,446,833 | 8/1948 | Johnson | 125/11 TP |
| 2,469,365 | 5/1949 | Braaten | 125/11 TP |
| 2,907,315 | 10/1959 | Hill | 125/11 PH |
| 4,103,668 | 8/1978 | Nishimura | 125/11 CD |
| 4,262,456 | 4/1981 | Haug | 125/11 CD |
| 4,419,612 | 12/1983 | Reda | 51/165.71 |

OTHER PUBLICATIONS

Continuous Path Jig Grinder, Model G-18P, Moore Precision Tools, Data Sheet, dated prior to 8-29-84.

*Primary Examiner*—Harold D. Whitehead
*Attorney, Agent, or Firm*—Edward J. Timmer

[57] ABSTRACT

In dressing a grinding wheel having a non-cylindrical contour, the wheel is moved in a path corresponding substantially to the desired wheel contour by first and second CNC controlled slides while a single point diamond or diamond roll dresser is rotated by a CNC controlled rotary mechanism through selected angles during traversal of the wheel therepast to maintain a vertical reference plane containing the centerline or mid-plane of the diamond dresser point or radius substantially orthogonal to a vertical reference plane containing a tangent to the wheel contour path. Maintenance of the orthogonal relationship between the single point diamond dresser point or radius and wheel contour path during traversal results in the desired wheel contour being accurately dressed.

2 Claims, 18 Drawing Figures

ORTHOGONAL DRESSING OF GRINDING WHEELS

This application is a division of application Ser. No. 645,373, filed 8-29-84.

FIELD OF THE INVENTION

The present invention relates to methods for dressing a non-cylindrical contour on a grinding wheel and to a dressing control system.

BACKGROUND OF THE INVENTION

In the past, it has been common to dress a grinding wheel by passing the wheel by a dressing tool which may be a single point diamond or diamond wheel whose outer surface is the outer half of a toroid. If the grinding wheel is moved in the desired wheel contour path past the diamond dresser which is stationary, there are limits to the slope which the contour may have if dressing contact is to be confined to the working point or radius of the dresser. At slopes of contour greater than that limit, dressing contact between the diamond and wheel will not have the form or shape which the wheel movement was designed to produce. The problem is encountered when the grinding wheel has other than a cylindrical shape.

What is needed is a dressing method and apparatus where contact of the working point or radius of the dresser tool with the grinding wheel moving therepast in a wheel contour path is maintained and thus dresses the desired contour on the grinding wheel, especially when the contour is non-cylindrical.

U.S. Pat. No. 4,419,612 issued Dec. 6, 1983 to Reda et al. discloses a grinding machine having an electromechanical control system for controlling all of the movements of one or more slides on a single workhead grinding machine using a feed control computer interfaced with servo-drive means which in turn controls a slide electric drive motor means.

U.S. Pat. No. 4,023,310 issued May 17, 1977 to Lovely and Hobbs describes a grinding machine having a dresser assembly mounted pivotally on a slide bar for being brought into dressing engagement with a grinding wheel. A single point diamond is shown mounted in a rotatable holder; however, the single point diamond is rotated to form a desired shape such as convex or concave contour on the grinding wheel, not to maintain orthogonality between the diamond dresser and wheel contour path provided by movement of a compound slide assembly.

SUMMARY OF THE INVENTION

It is an object of the invention to provide a dressing method and control system which satisfies the aforementioned need.

It is a further object of the invention to provide a dressing method which permits the form of the wheel contour to be independent of the form of the dresser tool.

It is still a further object of the invention to provide a dressing method and control system for producing non-cylindrical dressed wheel contours which could otherwise not be provided with known sizes and shapes of diamond or other dressers.

The present invention contemplates a dressing method in which the wheel contour and dresser are traversed relative to one another by providing first and second sets of linear slide position data to first and second slide control means for generating a traversal path corresponding substantially to the wheel contour and in which the dresser is rotated through selected angles during traversal to maintain a reference plane containing the dresser tip, point or other dresser working section substantially orthogonal to a plane containing a tangent to the wheel contour path at dressed locations on the wheel contour by providing a third set of rotary dresser position data to rotary dresser control means in coordination with the sets of first and second linear slide position data used to generate the traversal path.

In a typical working embodiment of the invention, the grinding wheel is carried on a compound slide assembly including a first slide and second slide normal to the first while the dresser is rotatably mounted on a support base that is fixed in position relative to the first and second slides. A control computer is interfaced to first and second slide electric motor servo controllers or drives and controls the slides by first and second sets of linear slide position data or signals to continuously move the grinding wheel in a traversal path corresponding substantially to the desired wheel contour past the dresser tool. The computer is also interfaced to a dresser electric motor servo controller or drive and controls the dresser by a third set rotary dresser position data or signals to continuously rotate through selected angles necessary to maintain a reference plane containing the working section such as the tip, point or radius thereof, substantially normal or orthogonal to a reference plane containing a tangent to the wheel contour path at dressed locations on the wheel contour. In this way, the working tip, radius or other working section of a diamond dresser tool is maintained substantially orthogonal to the traversal path to provide the dressed wheel contour desired without inaccuracies due to side contact between the wheel and diamond dresser tool.

DESCRIPTION OF PREFERRED EMBODIMENTS

Figure 1:
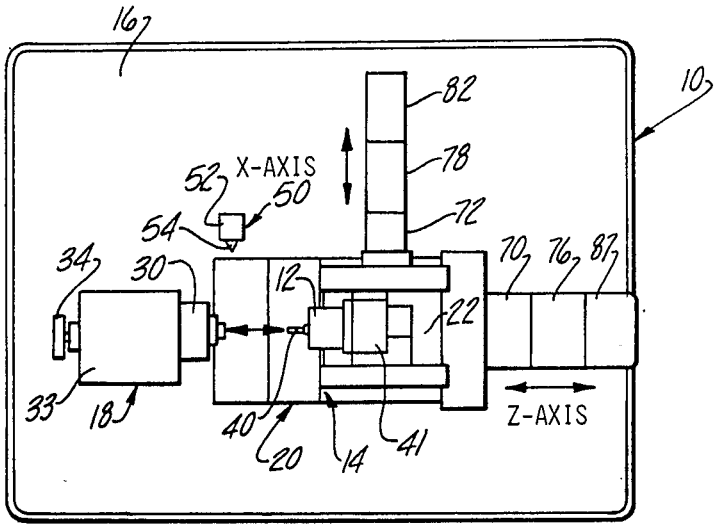
FIG. 1 illustrates schematically a grinding machine to which the invention is applicable having a single wheel spindle movably carried on a compound slide assembly.

Referring to FIG. 1, the numeral 10 generally designates a one-station electro-mechanical internal grinding machine with a single grinding wheel spindle 12 on a compound slide assembly 14.

The grinding machine 10 includes a conventional bed or base member 16 on which is operatively mounted a conventional workhead 18. The compound slide assembly 14 is also mounted on the base member 16 and includes a longitudinal or Z-axis slide 20 mounted on base 16 and a cross or X-axis slide 22 operatively mounted on Z-axis slide 20. The wheel spindle can be moved simultaneously in the Z-axis and X-axis directions by slides 20 and 22 as is well known.

The workhead 18 may be of any suitable conventional structure and includes a chucking fixture 30 for holding a workpiece. The chucking fixture 30 may be of the centerless type and rotated by a motor 33 and pulley 34 on the workhead 18.

As shown in FIG. 1, a grinding wheel 40 is operatively held in the spindle 12 which is rotated by motor 41. By movement of the Z-axis and X-axis slides 20 and 22, the grinding wheel 40 can be moved to and from the workpiece held in chucking fixture 30 and into contact with the workpiece; e.g., into contact with an inner bore, to grind same as is known.

The grinding wheel 40 is also movable by the Z-axis and X-axis slides 20 and 22 to and from the dresser 50 located laterally toward the side of the base member 16. In the embodiment shown in FIG. 1, the dresser 50 includes a support base 52 fixed in position on the base member so that the grinding wheel 40 is brought to and from the dresser 50 to effect dressing thereof. The dresser will be described in greater detail hereinbelow.

Figure 2:
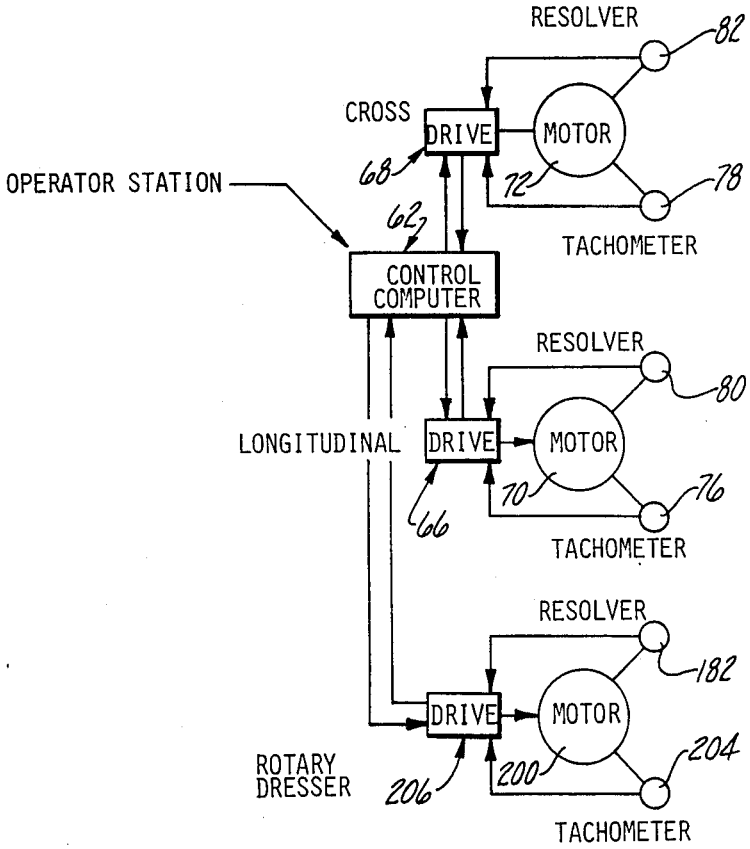
FIG. 2 is a block diagram of an illustrative control system in accordance with the principles of the present invention.

FIG. 2 is a block diagram of the control system employed to control movements of the Z-axis and X-axis slides 20 and 22 as well as rotation the dresser tool 54 of the dresser 50. The numeral 62 generally designates a control computer which is programmed to control all machine functions and interlocks. Such functions include lubrication status, safety interlocks, motor status and operation control station information. The control computer 62 may be any suitable digital computer or micro-processor. The control computer 62 has stored the positions and rates for all the axis moves for the various sequences which may include a grind cycle, dress cycle and so forth. The control computer 62 sends servo drive signals to the servo drive means 66 and 68 for controlling the servo motors 70,72 with respect to the respective Z-axis and X-axis slides to cause the grinding wheel to move in the desired wheel contour path. The servo drive means 66,68 take feedback from the tachometers 76,78, respectively. The numerals 80,82 designate either resolvers, encoders or "INDUCTOSYN" transducers and they provide feedback signals to the drive means 66,68, respectively, in closed servo loop manner with the tachometers.

A suitable control computer 62 is available on the market from Intel Corp. of Santa Clara, Calif. 95054 and sold under the name of "INTEL" (a trademark) 86/05 Single Board Computer. The servo drive means 66,68 may be any suitable servo drive means as, for example, a servo drive available on the market from Hyper Loop, Inc. of 7459 W. 79 St., Bridgeview, Ill. 60455 under the trademark "HYAMP". The HYAMP servo drive is a single phase, full wave, bi-directional SCR servo drive for D.C. motors and it provides D.C. drive power for precise speed control and regulation over a wide speed range. Another suitable servo drive designated as Size 50 is available from General Electric Co., 685 West Rio Rd., Charlottsville, Va. 22906.

The servo motors 70,72 may be any suitable D.C. servo motor. Suitable D.C. servo motors of this type are available from Torque Systems Inc., 225 Crescent St., Waltham, Mass. 02154 under the trademark "SNAPPER" and identified as frame sizes 3435 and 5115. A larger motor of this type is also available from the H. K. Porter Co., 301 Porter St., Pittsburgh, Pa. 15219.

The tachometers 76,78 are part of the D.C. servo motors. The resolvers, encoders or INDUCTOSYN transducer 80,82 are commercially available items and may be any suitable conventional position feedback devices available on the market. Resolvers of this type are available from the Clifton Precision Company of Clifton Heights, Pa. 19018. INDUCTOSYN precision linear and rotary position transducers are available from Farrand Controls, a division of Farrand Industries, Ind., 99 Wall St., Valhalla, N.Y. 10595. A suitable optical shaft angle encoder designated as Model No. DRC-35 is available from Dynamics Research Corp., 60 Concord St., Wilmington Mass. 01887.

The Z-axis and X-axis slides 20,22 are driven and controlled by the control system described above by a conventional ball screw (not shown), Acme screw or other screw means rotated by servo motors 70,72 as explained in U.S. Pat. No. 4,419,612 issued Dec. 6, 1983 of common assignee, the teachings of which are incorporated herein by reference.

The operation of such a grinding machine 10 in the grinding mode under control of a control computer is described in detail in the aforementioned U.S. Pat. No. 4,419,612 incorporated herein by reference hereinabove.

In the wheel dressing mode, the Z-axis and X-axis slides 20,22 are sequenced by the control system described hereinabove to convey the grinding wheel 40 to the dresser 50 located adjacent the side of the machine on base member 16. At the dresser, the Z-axis and X-axis slides 20,22 are moved under the control of control computer 62 in accordance with grinding wheel contour data or information input into the computer 62 and consisting of first and second sets of first and second linear slide position data or servo drive signals which will cause the slides 20,22 to move the grinding wheel 40 in a path relative to the dresser tool 52 corresponding substantially to the desired wheel contour. Illustrative types of grinding wheel contours that can be dressed are illustrated in FIGS. 4A–4G, but dressable contours are not limited thereto.

Figure 3:
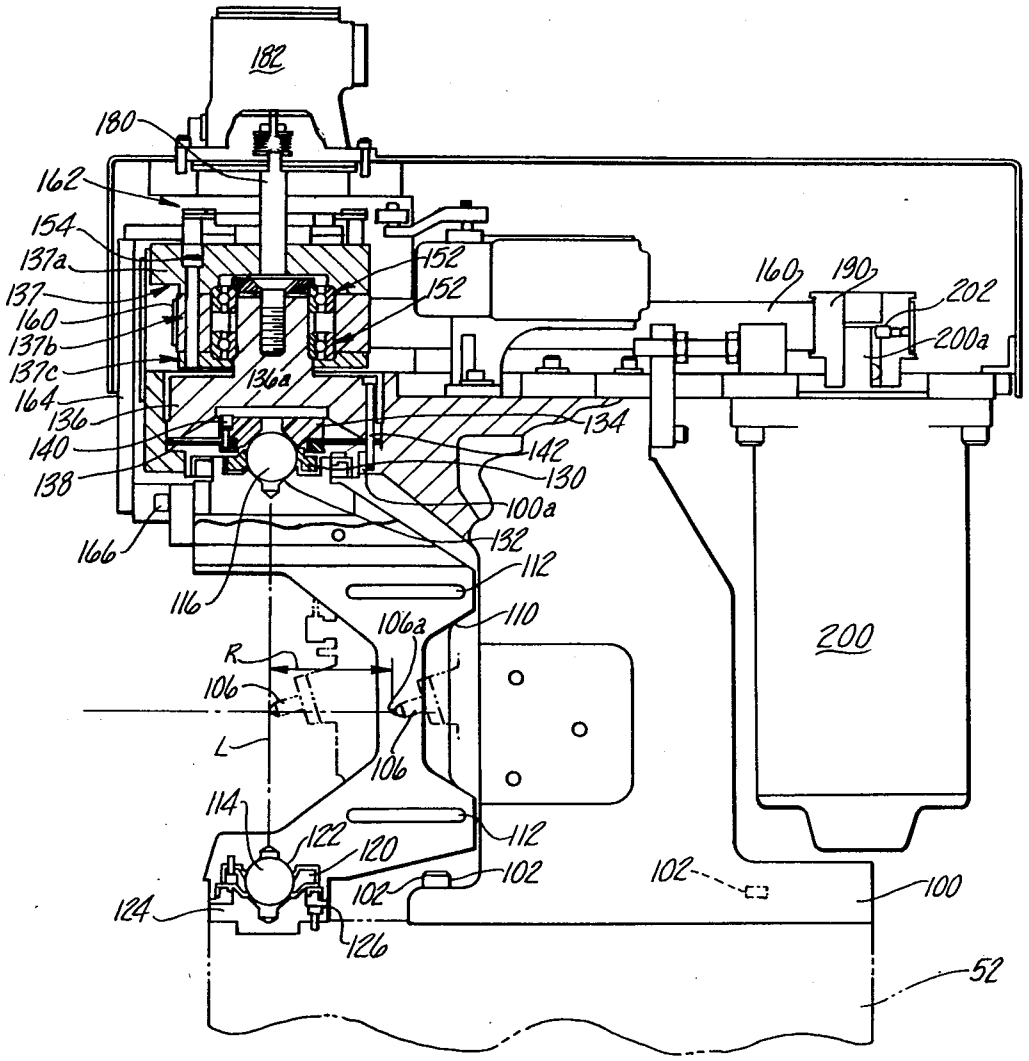
FIG. 3 is a sectional view of the dresser assembly.
Figure 4A:
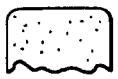
FIGS. 4A–4G illustrate typical grinding wheel contours which can be dressed by the method of the invention.
Figure 4B:
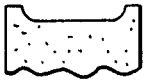
Figure 4C:
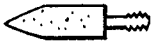
Figure 4D:
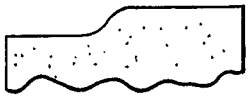
Figure 4E:
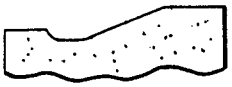
Figure 4F:
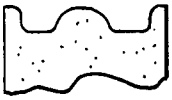
Figure 4G:
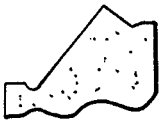

The dresser 50 includes a dresser housing 100 mounted on dresser base 52 by means of machine screws 102, FIG. 3. A single point diamond dresser tool 106 is mounted on support plate 108 which in turn is mounted on dresser arm 110 by means of machine screw bolts 105 extending through parallel spaced apart slots 112 in the dresser arm and captive nuts 107 in recesses in the right side of the support plate and closed off by plates 109 to capture nuts 107, FIGS. 5A and 5B. By such mounting, the support plate 108 and single point diamond dresser tool 106 thereon can be slid relative to the dresser arm for purposes to be explained.

The dresser arm 110 is rotatably mounted at the top and bottom on pivot balls 114,116, respectively, so that the dresser arm can rotate during dressing the grinding wheel 40 as will be described. A lower ball clamp 120 secures the ball 114 to the ball seat 122 of the dresser arm while a complementary ball seat 124 is attached to the dresser base 52 by multiple machine screws 126 (only one shown). An upper ball clamp 130 secures the ball 116 in the upper ball seat 132 on the dresser arm 110. A ball seat 134 is attached to a housing insert 136 by means of an annular steel diaphragm spring 138, the inner periphery of which is fixedly clamped to the ball seat 134 by multiple machine screws 140 (only one shown) and the outer periphery of which is fixedly clamped to the housing insert 136 and dresser housing shoulder 100*a* by multiple machine screws 142 (only one shown). The housing insert includes a reduced diameter upper cylindrical portion 136*a* on which a pulley 137 is rotatably mounted by a pair of spaced anti-friction bearing means 152 as shown. The pulley 137 includes a top portion 137*a*, belt engaging portion 137*b*, and bottom portion 137*c* connected together by multiple machine screws 154 (only one shown). The bearings 152 carry the belt tension load from belt 160 during rotation of the pulley 137.

An Oldham coupling 162 is carried on the top portion 137*a* of the pulley and is connected to a torque link 164 as shown. The torque link 164 in turn is connected to the dresser arm 110 by multiple machine screws 166 (only one shown). As is well known, the Oldham coupling includes two orthogonal sliding keys to prevent transmission of any bending movement to the torque link and thus to dresser arm 110. Only torque is transmitted by the Oldham coupling to impart pure rotation to the dresser arm.

Rotational position of the dresser arm 110 and thus dresser tool 106 is sensed by the combination of shaft 180 attached to the top portion 137*a* of the pulley for rotation therewith and resolver 182 attached on the dresser housing 52 to sense the rotary position of the shaft and thus indirectly the rotary position of the dresser arm 110 and single point diamond dresser tool 106 carried thereon. Servo drive means 206 takes feedback from the resolver 182 in closed servo loop manner, FIG. 2. The resolver 182 may be of the known commercially available rotary type described hereinabove.

Belt 160 drivingly engaged around the belt engaging portion 137*b* of the pulley is engaged at the other end around another pulley 190 which in turn is mounted on the output shaft 200*a* of servo motor 200 by cross screw 202 for rotation with the output shaft. Servo motor 200 includes a conventional tachometer 204. As shown in FIG. 2, the servo motor 200 receives servo signals from the servo drive means 206 which may be of the known commercially available type described hereinabove. The servo drive means 206 is interfaced with the control computer 62 along with the drive means 66,68 for the Z-axis and X-axis slides 20,22. With respect to the movement of the rotary dresser arm 110 and thus the diamond dresser tool thereon, the control computer 62 has stored therein sufficient sets of first and second linear slide position data for controlling the Z-axis and X-axis slides 20,22 to move the wheel 40 in a path corresponding substantially to the desired wheel contour at the dressing position adjacent and in contact with dresser 50. For each set of first and second linear slide position data the feed control computer 62 calculates a third set of rotary dresser position data required to maintain the vertical plane containing the centerline through the tip of the single point dresser 106 substantially orthogonal to the wheel contour during dressing using the known wheel contour desired and the sensed position (feedback) on the contour. The third set of rotary dresser position data could also be pre-calculated and input into the computer 62 in desired digital form. Of course, the control 62 uses the stored sets of linear slide position data and rotary dresser position data in combination with servo loop feedback from the associated resolvers and tachometers to control the dressing operation and provide the desired dressed wheel contour.

In this mode of dressing, the single point diamond dresser tool 106 is positioned with its tip or point 106*a* on the pivot line L extending between ball bearings 114,116 as shown in FIG. 3. When the dresser arm 110 is then pivoted or rotated about the pivot line, the single tip or point 106*a* of the dresser tool remains on the line and only the angular orientation of the diamond dresser tool is varied to bring a normal plane through the diamond point substantially orthogonal to the wheel contour.

Figure 5A:
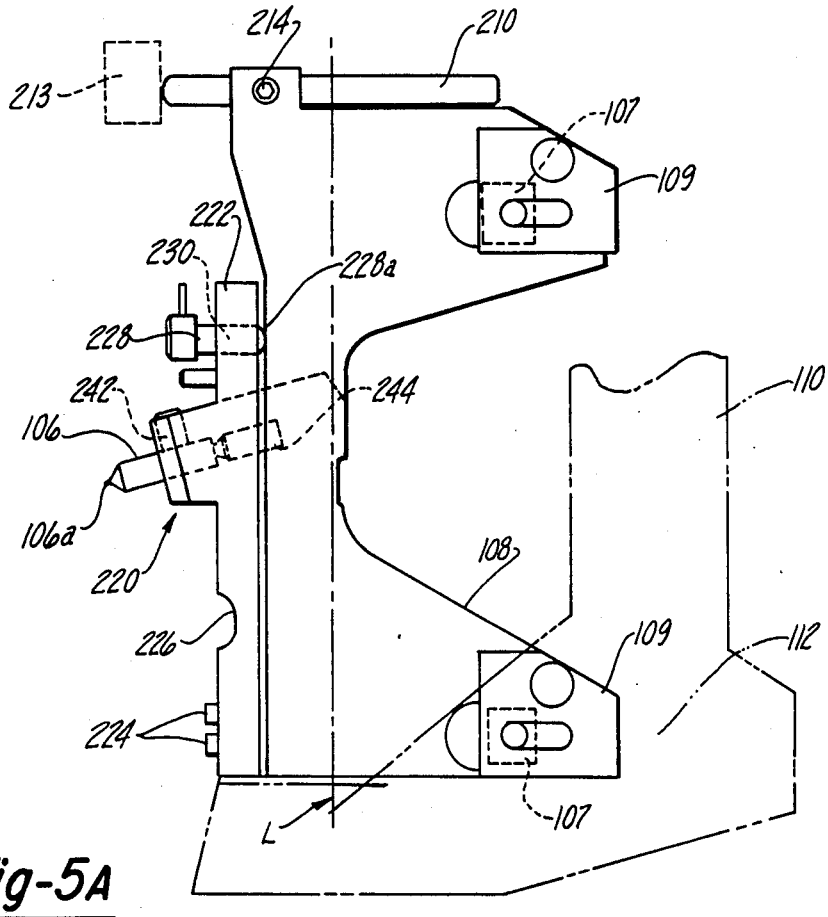
FIG. 5A is a side elevational view of the dresser support mechanism and FIG. 5B is a front elevational view thereof.
Figure 5B:
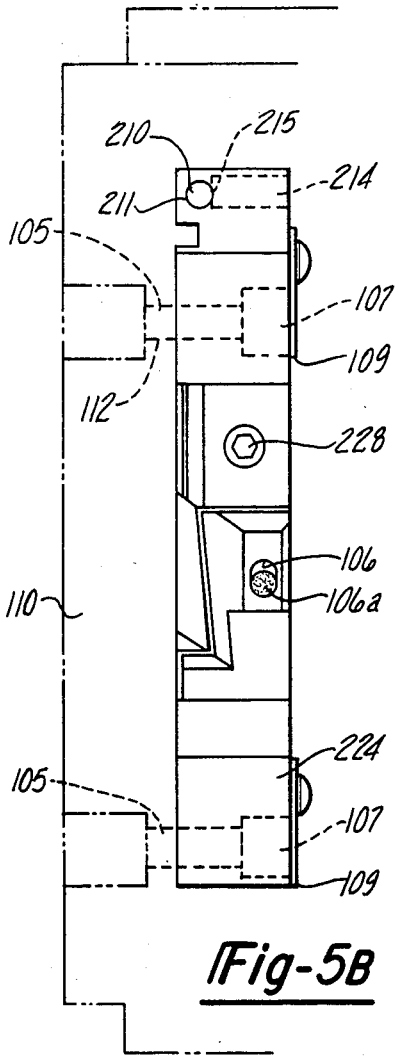

Referring to FIG. 5A, positioning of the diamond dresser tool 106 on pivot line L is accomplished in a coarse manner by sliding diamond support plate 108 relative to the dresser arm 110 by turning a long set screw 210 threaded into tapped hole 211 on a flange 212 of the support plate 108. The set screw 210 abuts a shoulder 213 on dresser housing 100 at the left end to effect relative movement of the support plate. A lock screw 214 is tightened against the long set screw 210 with a soft metallic disc 215 therebetween to lock the support plate position.

Fine adjustment of the position of the diamond tip or point 106*a* on the pivot line L is accomplished by a fine adjustment mechanism 220. Mechanism 220 includes an adjustment plate 222 attached at its lower end by machine screws 224 to the left side of slidable support plate 108 and having a cross-slot 226. An adjustment screw 228 is threadably received in a tapped hole 230 at the top of the adjustment plate and includes a rounded end 228*a* that engages against the support plate 108 as shown. By threading adjustment screw 228 into the tapped hole 230, the adjustment plate 222 carrying the diamond dresser tool can be resiliently deflected away from the support plate to move the tip or point 106*a* in an eccentric path toward the pivot line. Of course, threading of the adjustment screw in the opposite direction will allow the resiliency of the adjustment plate to move the tip or point 106*a* away from the pivot line toward the support plate 108.

Figure 6:
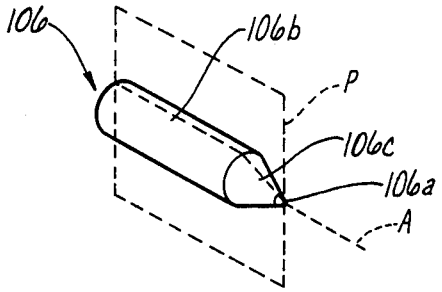
FIG. 6 is a perspective view of a single point diamond dresser.

Referring to FIG. 6, the diamond dresser tool 106 comprises an elongated body 106*b* having a longitudinal axis A and having a frusto-conical end 106*c* terminating in the single working point 106*a*. Ideally, the dresser working point 106*a* is truly a point; however, after some use in dressing, the point 106*a* will be dulled and be defined by an approximate point radius as is known. In FIG. 6, it is apparent that the vertical plane P through and containing the dresser point 106*a* also contains the longitudinal axis A of the dresser tool 50.

As shown best in FIG. 5A, the dresser tool 106 is held on the adjustment plate 222 by threaded lock pins 242,244.

Figure 7:
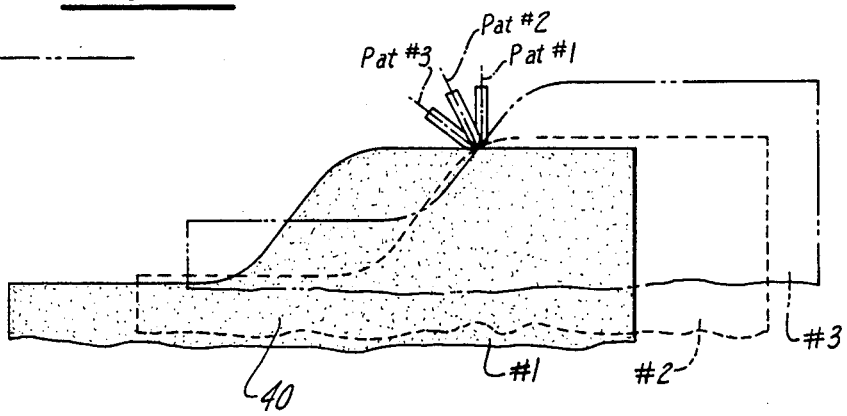
FIG. 7 is a schematic illustration showing the orthogonal relation of the dresser point to the tangent to the wheel contour.
Figure 8:
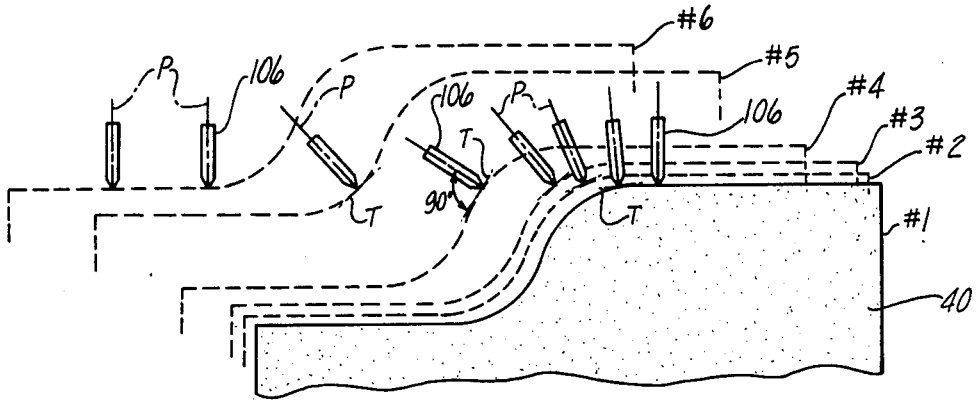
FIG. 8 is a schematic illustration showing the orthogonal relation between the dresser and wheel contour wherein the different angular orientations of the dresser are shown separately for purposes of clarity, it being appreciated that the different angular orientations shown would be superimposed on the dresser shown at #1 wheel position.
Figure 9:
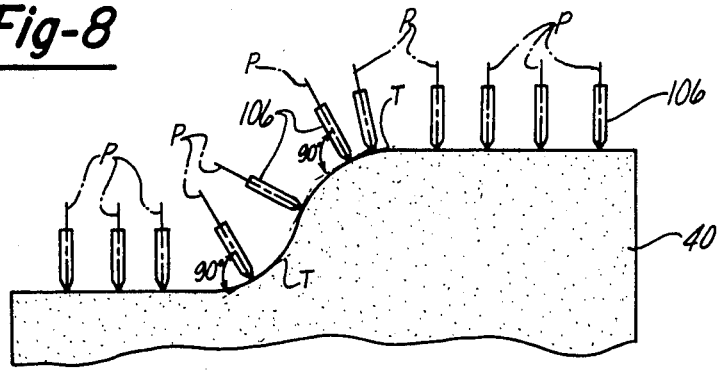
FIG. 9 is a schematic illustration showing the orthogonal relation where the dresser is moved past the grinding wheel.

In accordance with the present invention the vertical plane P through and containing the centerline of the dresser point or radius 106*a* is maintained substantially orthogonal to the plane T containing a tangent to the desired wheel contour path during dressing as illustrated in FIGS. 7–9. The word "vertical" for the reference planes P and T is used for clarity only and assumes application of this invention to a conventional "horizontal" machine. The invention is not limited to application to "horizontal" machines and any other set of orthogonal planes appropriate for some other machine orientation is intended to be included in the invention.

Although the centerline or longitudinal axis A of the dresser body is slightly inclined to the tangent plane T to the wheel contour C, FIG. 3, the objects of the invention are achieved so long as the vertical plane P containing the centerline of the dresser point or radius is substantially orthogonal to the tangent plane T as shown in FIG. 7–9. It is apparent that by maintaining the vertical plane P containing the dresser working point, tip/radius or other working section substantially orthogonal to the vertical plane containing the tangent to the wheel contour, proper dressing contact is effected for any wheel contour and unwanted contact between the side of the dresser and grinding wheel is prevented.

Figure 10:
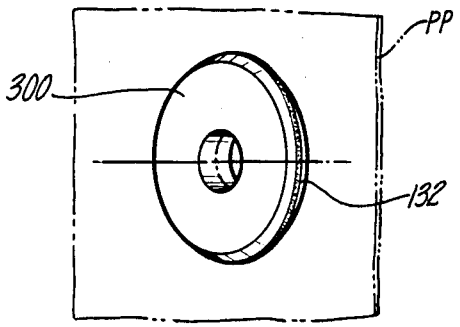
FIG. 10 is a side elevation of a diamond roll dresser.
Figure 11:
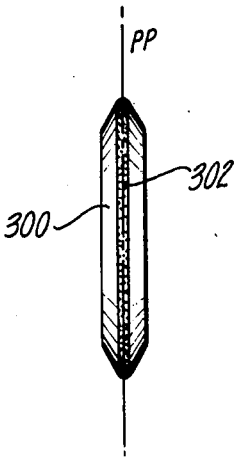
FIG. 11 is a front elevation of the dresser of FIG. 10.

Referring to FIGS. 10 and 11, a diamond roll dresser 300 with a small toroidal cross-section radius working surface 302 is shown and may be used in the method of the invention in lieu of the single point diamond dresser 106. Using the roll dresser 300, the vertical mid-plane or center plane PP of the small radius working surface 302 is maintained substantially orthogonal to the plane containing the tangent to the wheel contour by continuously rotating the dresser arm 110 in accordance with the position of the roll dresser 300 along the wheel contour as explained above; i.e., the computer 62 calculates the necessary angular or rotary movement for the dresser servo motor 200 for a given set of slide linear position data for the X-axis and Z-axis slides.

In another mode of dressing, the working point or radius of the dresser tool (106 or 300) can be spaced from the pivot line L by a fixed distance by movement of slide support 108. In this mode, the dresser point or radius would move in an eccentric path upon rotation of the dresser arm 110. The computer 62 can be programmed to control the X-axis and Z-axis slides and rotary position of the dresser to account for such eccentric dresser point movement to maintain the dresser wheel orthogonal relationship described hereinabove.

Although certain preferred embodiments of the invention have been described hereinabove and illustrated in the Figures, it is to be understood that modifications and changes may be made therein without departing from the spirit and scope of the invention as defined in the appended claims.

We claim:

1. An electro-mechanical system for dressing a grinding wheel carried on first and second slide means and a rotatable dresser having a working section for dressing the grinding wheel in a desired wheel contour comprising computer means for providing first and second sets of linear slide position data together representing movement of the grinding wheel in a path corresponding substantially to the desired wheel contour and for providing a third set of rotary dresser position data representing angular movement of the dresser with movement of the grinding wheel on the wheel contour path to maintain a reference plane through the dresser working section substantially orthogonal to a reference plane containing a tangent to the wheel contour path at locations thereon, first and second electric motor driven screw actuator means connected to the respective first and second slide means for driving the slide means in a sequence to move the grinding wheel along the desired wheel contour path in contact with the dresser, electric motor means for continuously rotating the dresser, servo means for interfacing said computer means and said electric motor driven screw actuator means and dresser rotary means, said servo means including first and second slide position feedback means for the respective first and second slide means and a dresser rotary position feedback means for the dresser for controlling the linear movement of the first and second slide means and rotary movement of the dresser to effect dressing of the wheel contour with a reference plane through the dresser working section maintained substantially orthogonal to a plane containing a tangent to the wheel contour path during the dressing operation.

2. The system of claim 1 wherein the computer calculates the third set of rotary dresser position data as the first and second linear slide position data are called up from storage.

* * * * *